US006223806B1

(12) United States Patent
Nishino et al.

(10) Patent No.: US 6,223,806 B1
(45) Date of Patent: May 1, 2001

(54) APPARATUS AND METHOD FOR BOTTOM CASTING OF MOLTEN STEEL

(76) Inventors: Kazuhisa Nishino, 17-85, Higashinaniwachou 2-chome, Amagasaki-shi, Hyogo, 660-0892; Eiju Hayakawa, 56-6, Izumiharachou, Yamatokouriyama-shi, Nara, 639-1056, both of (JP)

( * ) Notice: Subject to any disclaimer, the term of this patent is extended or adjusted under 35 U.S.C. 154(b) by 0 days.

(21) Appl. No.: 09/520,882

(22) Filed: Apr. 5, 2000

(30) Foreign Application Priority Data

Apr. 8, 1999 (JP) ..... 11-100733

(51) Int. Cl.[7] ..... B22C 9/08
(52) U.S. Cl. ..... 164/133; 164/363
(58) Field of Search ..... 164/133, 337, 164/363, 370, 364

(56) References Cited

U.S. PATENT DOCUMENTS 3,599,708 * 8/1971 Suzuki et al. ..... 164/337
3,672,432 * 6/1972 Widdowson et al. ..... 164/119
3,837,614 * 9/1974 Palovits et al. ..... 249/108

FOREIGN PATENT DOCUMENTS 53-35897 9/1978 (JP) .
6-218494 8/1994 (JP) .

* cited by examiner

*Primary Examiner*—Harold Pyon
*Assistant Examiner*—Len Tran

(57) ABSTRACT

A bottom casting apparatus comprises a pouring pipe, a stool, molds, and runners, wherein the runner satisfies the following equations (1) and (2) and a gap formed between a side wall of a groove for a runner provided in the stool and a runner brick is filled with heat resisting granules, $$A-D \leq D(Z/100)+2.5 \text{ (mm)} \quad (1)$$

$$A-D>B-E>0 \quad (2)$$

where, A and B are widths (mm) at an upper portion and a bottom portion of the groove, respectively, D and E are widths (mm) at an upper portion and a bottom portion of the runner brick disposed within the groove, respectively, and Z is a mean coefficient of linear expansion (%) of the runner brick in the temperature range of a room temperature to 1000° C.

2 Claims, 3 Drawing Sheets

APPARATUS AND METHOD FOR BOTTOM CASTING OF MOLTEN STEEL

This application claims priority under 35 U.S.C. § § 119 and/or 365 to JP11-100733 filed in Japan on Apr. 8, 1999, the entire content of which is herein incorporated by reference.

BACKGROUND OF THE INVENTION

1. Field of the Invention

The present invention relates to an apparatus and a method for bottom casting of a molten steel.

2. Description of the Related Art

As compared with a top casting method, a bottom casting method can provide higher efficiency in casting a molten steel and eliminate possible splashing of a molten steel in a mold, causing a smooth surface of an ingot. Therefore, the bottom casting method is adapted to cast a steel such as a stainless steel.

An apparatus for use in bottom casting, comprises a stool, a pouring pipe and a mold mounted thereon. In the apparatus, a bottom surface of the pouring pipe communicates with a bottom surface of the mold through a runner brick disposed within a groove formed in the stool, allowing molten steel to flow through the pouring pipe into the mold. The pouring pipe generally comprises a cylindrical outer barrel made of cast iron and a cylindrical pouring pipe brick disposed within the outer barrel.

In casting performed by the bottom casting method, molten steel poured into the pouring pipe flows through the runner brick into the mold, and solidifies to form an ingot within the mold. While molten steel within the mold is cooled, molten steel remaining within the pouring pipe and the runner brick also solidifies. Therefore, in each ingot casting completion, the pouring pipe and the runner brick which have been used are removed and replaced with fresh ones.

A work in which the runner brick is disposed in the stool is called "runner brick setting". The work is conventionally performed in the following manner. That is, after the bottom of the groove formed on the stool is filled with sand, a plurality of runner bricks are disposed within the groove along the length thereof, and seam between adjacent runner bricks is sealed. Thereafter, a space between a side wall of the groove and the runner bricks is filled with sand, and an upper portion of sand is covered with mortar.

However, in the conventional method mentioned above, a work for filling the sand and a work drying the mortar securing the sand are required, thereby lowering workability and polluting the working ambiance due to occurrence of dust. Accordingly, for solving the above problem, methods for setting runner bricks without using sand and/or mortar have been disclosed in Japanese Patent Application Publication (JP-B) No. 53-35897, and Japanese Patent Application Laid-Open (JP-A) No. 6-218494.

In accordance with the method which has been disclosed in JP-B No. 53-35897, the width of each lateral gap between the groove and the runner brick is set to 6 mm or less, or metal plate is inserted in each gap in respective sides to adjust the width of the gap to be 6 mm or less. Even when molten steel flows out due to accidental cracking of the runner brick, the molten steel is cooled and solidified by the side wall of the groove of the stool or the inserted metal plate. Accordingly, molten steel can be prevented from flowing out further. However, in this method, when the width of the gap between the groove and the runner brick is, for example, about 4 mm, the opening width of the crack also become about 4 mm. Therefore, flowing-out of molten steel can not be prevented perfectly.

The method which has been disclosed in JP-A No. 6-218494 has been proposed by the assignee of the present invention so as to overcome disadvantages of the method which has been disclosed in JP-B No. 53-35897 mentioned above. In this method, the width of the lateral gap between the groove and the runner brick, and a difference between the depth of the groove and the height of the runner brick, which are measured in thermal expansion of the runner brick, are made 0.5 mm or less. Even when a crack accidentally occurs in the runner brick, an opening width of the crack can be suppressed to 0.5 mm or less, thereby providing molten steel from flowing out.

As mentioned above, after one casting work is completed, the used runner bricks are removed from the stool. The simplest way for removing the runner bricks one where, after the ingot, the outer barrel of the pouring pipe and the mold are removed from the stool, cause the stool is lifted up with a crane and reversed to cause the runner bricks and the pouring bricks to fall off at a stroke together with solidified material remained therein.

When this removing technique is applied to the method which has been disclosed in the JP-A No. 6-218494, the runner bricks on an upper region of the groove breaks and falls with the solidified material remaining in the runner, allowing them to be removed. However, since broken pieces or chips originated the runner bricks enter into a gap between the runner bricks disposed at a bottom side of the groove and the groove, some of the pieces of the runner bricks remain in the groove in some cases. In this case, it is necessary to remove the remaining pieces from the groove. For example, the reversed stool is returned back to its original state and a removing work must be performed using a breaker or the like. Accordingly, it takes a long time for a post-processing (post-treatment) after ingot casting.

SUMMARY OF THE INVENTION

It is an object of this invention to provide a bottom casting apparatus and a bottom casing method wherein a molten steel can be prevented from flowing out of a runner brick even when the runner brick is broken during pouring a molten steel, and a time required for a post-treatment performed after ingot casting can be shortened.

An apparatus for bottom casting of a molten steel according to the present invention comprises a pouring pipe, a stool, at least one mold, and at least one runner which is disposed on a groove of the stool and connects between the pouring pipe and the mold. The runner satisfies the following equations (1) and (2). A gap formed between each side wall of a groove for the runner in the stool and a runner brick is filled with heat resisting granules.

$$A-D \leqq D(Z/100)+2.5 \text{ (mm)} \quad (1)$$

$$A-D>B-E>0 \quad (2)$$

where A is an upper portion width (mm) of the groove for the runner provided in the stool, B is a bottom portion width (mm) of the groove for the runner in the stool, D is an upper portion width (mm) of the runner brick disposed in the groove for the runner provided in the stool, E is a lower portion width (mm) of the runner brick disposed in the groove for the runner provided in the stool, and Z is a mean coefficient (%) of linear expansion of the runner brick in the temperature range of the room temperature to 1000° C.

In the bottom casting apparatus, the groove for the runner is preferably formed to have the upper portion width A which is larger than the bottom portion width B. The runner brick is preferably formed to have the upper portion width D which is smaller than the bottom portion width E.

A bottom casting method for a molten steel according to the present invention is an ingot casting method using a bottom casting apparatus in which a runner connecting a pouring pipe and a mold to each other is formed in a manner according to the following (a) and (b).

(a) The runner is formed such that a relationship between a groove for the runner provided in a stool and a runner brick meets the following equations (1) and (2).

(b) Heat resisting granules are filled in a gap between a side wall of the groove for the runner of the stool and the runner brick.

$$A-D \leqq D(Z/100)+2.5 \text{ (mm)} \quad (1)$$

$$A-D>B-E>0 \quad (2)$$

where A is an upper portion width (mm) of the groove for the runner provided in the stool, B is a bottom portion width (mm) of the groove for the runner in the stool, D is an upper portion width (mm) of the runner brick disposed in the groove for the runner provided in the stool, E is a lower portion width (mm) of the runner brick disposed in the groove for the runner provided in the stool, and Z is a mean coefficient (%) of linear expansion of the runner brick in the temperature range of the room temperature to 1000° C.

DETAILED DESCRIPTION

Figure 1:
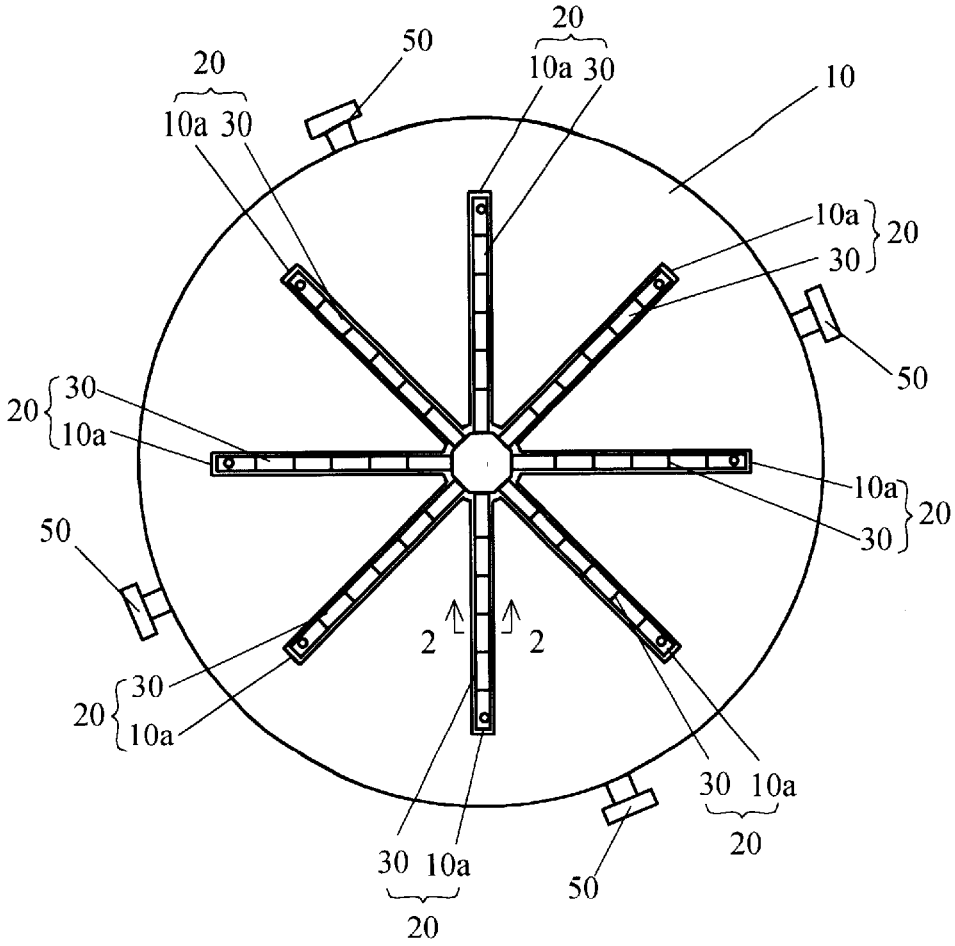
FIG. 1 is a schematic plan view showing an embodiment of a bottom casting apparatus.
Figure 2:
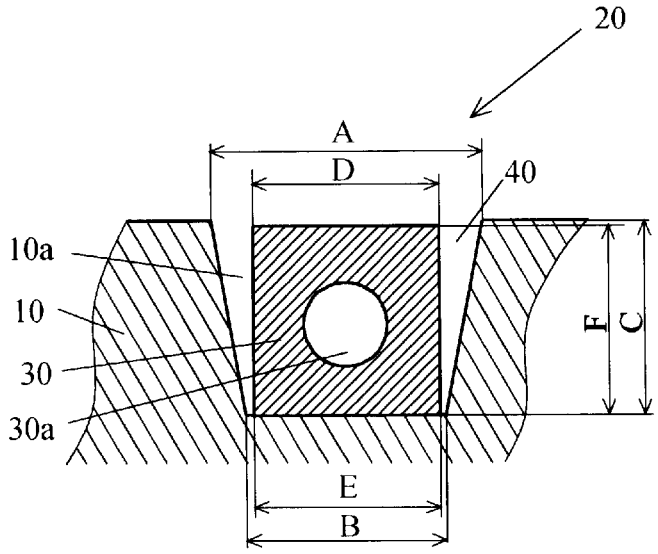
FIG. 2 is a cross-sectional view (taken along line 2—2 of FIG. 1.) showing an embodiment of a structure of a runner of a stool for the bottom casting apparatus of the present invention.
Figure 3:
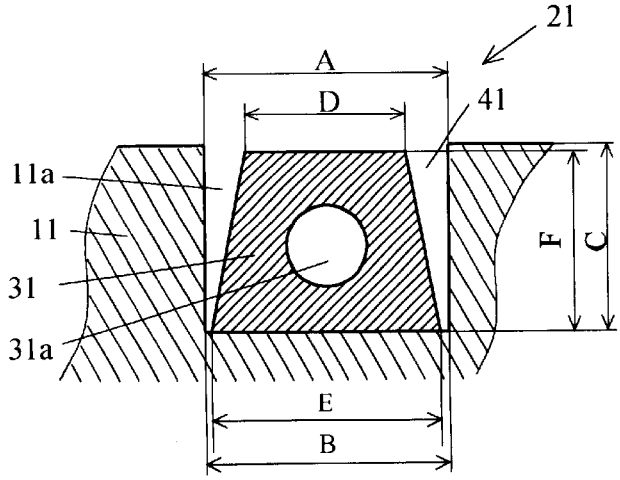
FIG. 3 is a cross-sectional view showing another embodiment of the structure of the runner of the stool for the bottom casting apparatus of the invention.
Figure 4:
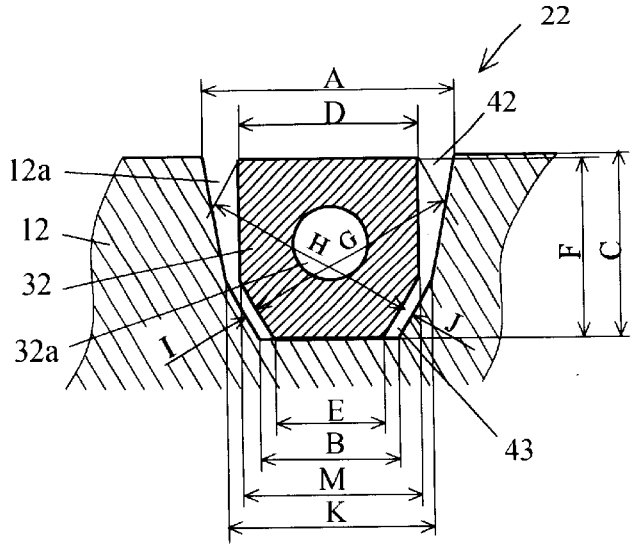
FIG. 4 is a cross-sectional view showing another embodiment of the structure of the runner of the stool for the bottom casting apparatus of the invention.
Figure 5:
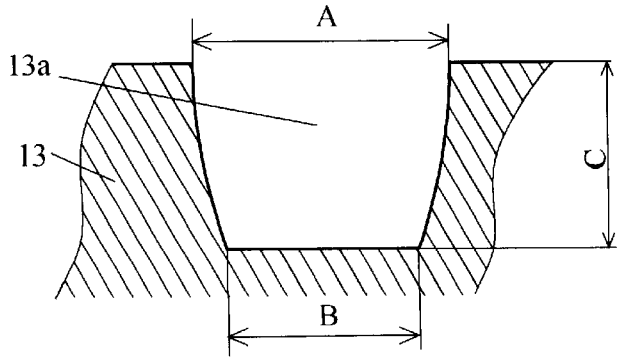
FIG. 5 is a cross-sectional view showing another embodiment of a groove provided in the stool of the invention.
Figure 6:
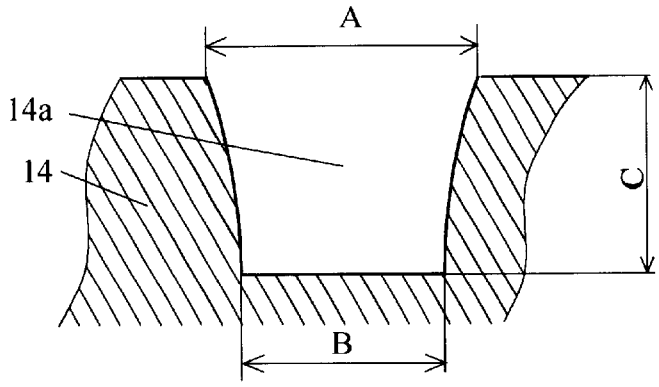
FIG. 6 is a cross sectional view showing another embodiment of the groove provided in the stool of the invention.
Figure 7:
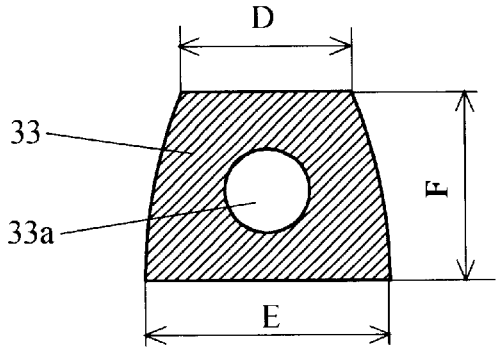
FIG. 7 is a cross-sectional view showing another embodiment of a runner brick of the invention.
Figure 8:
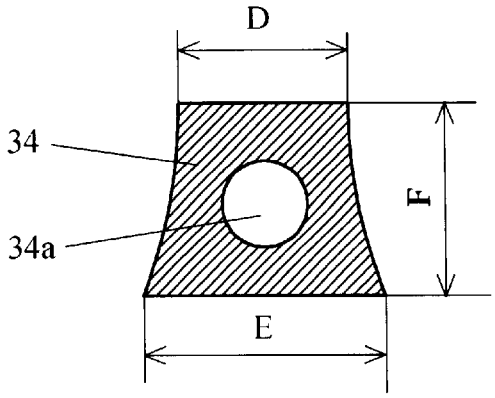
FIG. 8 is a cross-sectional view showing another embodiment of the runner brick of the invention.

FIG. 1 is a schematic plan view of an embodiment of a bottom casting apparatus. FIG. 2 is a cross-sectional view showing an embodiment of a structure of a runner of a stool for the bottom casting apparatus of the present invention, taken along line 2—2 of FIG. 1. FIGS. 3 and 4 are cross-sectional views showing other embodiments of the runner of the stool for the bottom casting apparatus of the invention are illustrated. FIGS. 5 and 6 are cross-sectional views of other embodiments of a groove provided in the stool. FIGS. 7 and 8 are cross-sectional views showing other embodiments of runner bricks of the invention.

As shown in FIG. 1, the bottom casting apparatus comprises a stool 10, runners 20, a pouring pipe (not shown), and molds (not shown). The stool 10 is made of cast iron, for example, and has a plurality of grooves 10*a* radically extending from the center of the stool and a plurality of hangers 50 provided on the periphery of the stool. Each of the runners 20 comprises a groove 10*a* provided for the runner in the stool, runner bricks 30 disposed in the groove 10*a*, and heat resisting granules packed into a gap between each side wall of the groove 10*a* and the runner bricks 30. The runner brick 30 is made of material such as high-alumina, chamotte, zircon or the like and disposed within the grooves 10*a* provided in the stool 10. When bottom casting is carried out, the pouring pipe (not shown) is disposed at the center of the stool 10, and the mold (not shown) is also disposed at the distal portion of the each groove 10*a*. In the bottom casting apparatus of the present invention, one or more mold may be disposed for one pouring pipe.

In the runner 20 shown in FIG. 2, the groove 10*a* is configured to have a trapezoidal cross section with an upper portion width A which is larger than a bottom portion width B, and with a depth C. The runner brick 30 is configured to have a rectangular cross section with an upper portion width D and a bottom portion width E which is equal to the former and with a height F, and a runner bore 30*a* is formed at the center of the runner brick 30. Dimensions with respect to the cross sections of the groove 10*a* and the runner brick 30 are defined so as to satisfy the following equations (1) and (2), $$A-D \leqq D(Z/100)+2.5 \text{ (mm)} \quad (1)$$

$$A-D>B-E>0 \quad (2)$$

where Z is a mean coefficient of linear expansion (%) (which can be simply called "thermal linear expansion coefficient") of the runner brick in the temperature range of a room temperature to 1000° C.

The mean coefficient Z of linear expansion of the runner brick of the present invention in the temperature range of a room temperature to 1000° C. is expressed as $(L_H-L_R)/L_R\times 100(\%)$, where $L_R$ is a length of the runner brick at a room temperature and $L_H$ is a length thereof at 1000° C.

When the runner 20 is formed, the runner bricks 30 are put in the groove 10*a* in the stool 10 such that they are generally centrally disposed in the groove 10*a*, and then a gap 40 between each side wall of the groove 10*a* and the runner bricks 30 is filled with heat resisting granules (not shown). The heat resisting granules are merely filled into the groove 10*a*, rather forcedly packed like conventional fashion. However, in order to prevent flowing-out of molten steel when a crack(s) occurs in the runner brick 30, an upper limit of the gap between the runner brick 30 and the side wall of the groove 10*a* should be set to 2.5 mm. The above equation (1) defines an upper limit of the gap between the runner bricks 30 and the side wall of the groove 10*a* at a room temperature.

The gaps formed between the side wall of the groove 10*a* and the runner brick 30 at the upper portion and the bottom portion is set as shown with equation (2). Since heat resisting granules is filled in the gap 40, the stool 10 is reversed in a state where it is lifted up by a crane or the like after an ingot casting work so that the heat resisting granules filled into the gap 40 may fall off easily and the runner brick 30 together with the solidified material remaining in the runner bore 30*a* falls off. When the runner brick 30 breaks off, broken pieces or chips of the runner brick 30 do not enter in the gap 40 because the gap is filled with the heat resisting granules. Incidentally as the heat resisting granules used in this invention, there are, for example, granules or particles of ceramic such as, silica or the like, or sand. Particularly the sand is economically preferable. An average particle size of the heat resisting granules preferably ranges from 20 mesh to 50 mesh.

In the runner 21 shown in FIG. 3, a stool 11 is provided with a groove 11*a* with a rectangular cross section which has an upper portion width A and a bottom portion width B equal to each other, and with a depth C. A runner brick 31 is provided at the center thereof with a runner bore 31*a* with a trapezoidal cross section with an upper portion width D which is smaller than a bottom portion width E, and with a height F.

The cross sectional dimensions of the groove 11*a* and runner brick 31 are set so as to satisfy conditions defined according to the following equations (1) and (2) in the same manner as the case of FIG. 2, $$A-D \leqq D(Z/100)+2.5 \text{ (mm)} \quad (1)$$

$$A-D>B-E>0 \quad (2)$$

where Z is a mean coefficient of linear expansion (%) of the runner brick in the temperature range of the room temperature to 1000° C.

In the case of this runner 21, runner bricks 31 are also put in the groove 11*a* of the stool 11 generally at the center thereof, and a gap 41 between a side wall of the groove 11*a* and the runner bricks 31 is filled with heat resisting granules such as sand (not shown) or the like in the same manner as the case of the runner 20 shown in FIG. 2.

In a runner 22 shown in FIG. 4, a stool 12 is provided with a groove 12*a* with a hexagonal cross section which has an upper portion width A, a middle portion width K and a bottom portion width B, and with a depth C. A runner brick 32 is formed in a hexagonal cross section with an upper portion width D, a middle width M, a bottom portion width E, and a height F and has a runner bore 32*a* formed therethrough.

The dimensions in cross sections of the groove 12*a* and the runner brick 32 are set so as to satisfy the following equations (1), (2), (3), (4) and (5), $$A-D \leqq D(Z/100)+2.5 \text{ (mm)} \quad (1)$$

$$A-D>B-E>0 \quad (2)$$

$$K-M \geqq B-E>0 \quad (3)$$

$$I \leqq G(Z/100)+1.25 \text{ (mm)} \quad (4)$$

$$J \leqq H(Z/100)+1.25 \text{ (mm)} \quad (5)$$

where Z is a mean coefficient of linear expansion (%) of the runner brick in the temperature range of the room temperature to 1000° C.

In the runner 22, the runner bricks 32 are also put in the groove 12*a* of the stool 12 generally at the center thereof, and an upper portion gap 42 and a bottom portion gap 43 between a side wall of the groove 12*a* and the runner brick 32 are filled with heat resisting granules such as sand (not shown) like the case of the runners 20 and 21 respectively shown in FIGS. 2 and 3.

In each runner as shown in FIGS. 2, 3 and 4, the dimensional distance (C−F) between the depth C of each of the groove 10*a*, the groove 11*a* and the groove 12*a* and the height F of each of the runner brick 30, the runner brick 31 and the runner brick 32 is preferably set fall in the range of −2 mm to +2 mm.

The stool 10 shown in FIG. 2 has the groove 10*a* whose side walls are slant. However, as shown in FIG. 5, a stool 13 which has a groove 13*a* whose side walls are outwardly swelled and a stool 14 which has a groove 14*a* whose side walls are inwardly swelled may be used. Beside, in each of stools shown in FIG. 5 and FIG. 6, an upper portion width A of each of the grooves 13*a* and 14*a* set wider than a bottom portion width B thereof.

The runner brick 31 shown in FIG. 3 has slanted surfaces, but a runner brick 33 shown in FIG. 7 may have outwardly swelled side surfaces, and a runner brick 34 shown in FIG. 8 may have inwardly swelled side surfaces. Incidentally, in each of the runner bricks of FIGS. 7 and 8, an upper portion width D thereof is set smaller than a bottom portion width E thereof.

EMBODIMENT

The bottom casting apparatus of the present invention shown in FIGS. 1 and 2, and a conventional bottom casting apparatus were used to make ingots with chemical compositions shown in Table 1 by bottom casting methods, and then runner bricks were removed from a stool. Tests-Time taken for setting runner bricks, whether the leakage of molten steel occurred or not, whether the bricks were removed off perfectly or not, and time taken for performing a post-processing after ingot casting were examined.

TABLE 1

| Chemical composition (wt. %, The balance is Fe and incidental impurities) | | | | | |
|---|---|---|---|---|---|
| C | Si | Mn | Ni | Cr | N |
| 0.05 | 0.50 | 1.50 | 9.20 | 18.46 | 0.03 |

Table 2 shows chemical compositions of runner bricks and mean coefficients of linear expansion (%) in the temperature range of the room temperature to 1000° C., and Table 3 shows dimensions of grooves formed in a stool and runner bricks disposed in the groove.

TABLE 2

| | Chemical composition (wt. %) | | | | | *Coefficient of |
|---|---|---|---|---|---|---|
| Sample | $SiO_2$ | $Al_2O_3$ | $Fe_2O_3$ | $TiO_2$ | $K_2O$ | linear expansion (%) |
| X | 30.1 | 65.4 | 1.6 | 2.2 | 0.4 | 0.70 |
| Y | 33.2 | 62.3 | 1.6 | 2.3 | 0.4 | 1.00 |

*The coefficient of linear expansion (%) is a mean value in the temperature range of a room temperature to 1000° C.

TABLE 3

| Sample | No. | Dimensions of grooves (mm) A | B | C | Runner brick Sample | Dimensions (mm) D = E | F | D(Z/100) (mm) | *1 Filler material | Clearance A–D | B–C | Time of runner brick setting | Flowing-out of molten steel | Remov-ability of brick | Time required for post-treatment after ingot casting (hr) |
|---|---|---|---|---|---|---|---|---|---|---|---|---|---|---|---|
| Embodiment | 1 | 102.5 | 101.0 | 101.2 | X | 100.0 | 100.0 | 0.7 | sand | 2.5 | 1.0 | 1 | non | ○ | 1 |
| Embodiment | 2 | 100.6 | 100.3 | 100.6 | X | 100.0 | 100.0 | 0.7 | sand | 0.6 | 0.3 | 1 | non | ○ | 1 |
| Comparative Example | 3 | 103.5 | 103.5 | 101.5 | X | 100.0 | 100.0 | 0.7 | not used | 3.5 | 3.5 | 0.96 | occurred | × | 3 |
| Comparative Example | 4 | 102.5 | 102.5 | 100.3 | X | 100.0 | 100.0 | 0.7 | not used | 2.5 | 2.5 | 0.96 | occurred | × | 4 |
| Comparative Example | 5 | 101.0 | 101.0 | 99.2 | X | 100.0 | 100.0 | 0.7 | not used | 1.0 | 1.0 | 0.96 | non | × | 3 |
| Comparative Example | 6 | 106.0 | 106.0 | 101.0 | X | 100.0 | 100.0 | 0.7 | steel plate (5.0) | 6.0 | 6.0 | 1.15 | non | × | 4 |
| Embodiment | 7 | 142.0 | 141.0 | 139.0 | X | 140.0 | 140.0 | 1.0 | sand | 2.0 | 1.0 | 1 | non | ○ | 1 |
| Comparative Example | 8 | 144.0 | 144.0 | 141.0 | X | 140.0 | 140.0 | 1.0 | not used | 4.0 | 4.0 | 0.96 | occurred | × | 3 |
| Comparative Example | 9 | 142.0 | 142.0 | 139.4 | X | 140.0 | 140.0 | 1.0 | not used | 2.0 | 2.0 | 0.96 | occurred | × | 3 |
| Comparative Example | 10 | 144.0 | 144.0 | 141.3 | X | 140.0 | 140.0 | 1.0 | steel plate (2.0) | 4.0 | 4.0 | 1.15 | occurred | × | 4 |
| Example | 11 | 102.5 | 101.0 | 100.6 | Y | 100.0 | 100.0 | 1.0 | sand | 2.5 | 1.0 | 1 | non | ○ | 1 |
| Comparative | 12 | 103.5 | 103.5 | 101.3 | Y | 100.0 | 100.0 | 1.0 | not used | 3.5 | 3.5 | 0.96 | occurred | × | 3 |
| Comparative Example | 13 | 105.0 | 105.0 | 100.2 | Y | 100.0 | 100.0 | 1.0 | steel plate (3.0) | 5.0 | 5.0 | 1.15 | occurred | × | 4 |

*1 Description "steel plate" represents that the steel plate was interposed in the gap, and numeral in the bracket shows the thickness (mm) of the steel plate used therefor.

In a bottom casting, molten steel with the chemical compositions shown in Table 1 at a temperature of 1570° C. was poured from a pouring pipe mounted at the center of a stool into eight molds mounted on pouring ports of runners communicating with the molds, wherein eight ingots with a weight of 3000 Kg were produced at the same time.

In a post-processing after ingot casting, the stool, from which the pouring pipe and the mold had been removed was suspended by a crane to be reversed, so that the runner bricks were fallen off and removed. Thereafter, the stool was returned back to its original state, and then the runner bricks still remaining in the runner were removed by a breaker.

The experimental results are shown in Table 3. Times required for setting runner bricks and for accomplishing the post-processing after casting according to the present invention method are respectively set to 1, and ratios to 1 are shown in Table 3. As to a removal state of the bricks, a symbol "○" was given to a state: "when the stool was reversed, the runner bricks feld completely without any residual pieces or chips thereof", while a symbol "x" was given to a state: "when the stool was reversed, even one piece of the runner brick remained without falling".

In the embodiments Nos. 1, 2, 7 and 11 of the present invention, no flow-out of molten steel was observed during ingot casting, and the runner bricks fallen completely by reversing the stool for the bottom casting in the post treatment after ingot casting.

Comparative examples (controls) Nos. 3, 4, 8, 9, 12 disclosed in the JP-B No. 53-35897 where were performed by the metal plates were not used when the runner bricks were set in the grooves of the stool. In these examples, times for setting of the runner bricks were shorter than those of the embodiments of the present invention, because of using no sand in the gap between the side walls of the groove of the stool and the runner bricks. However, during ingot casting, molten steel flowed out and solidified within the gap, so that the molten steel remained within the gap together with the pieces of the runner brick, thereby causing the post-treatment after ingot casting to require rather long time.

Comparative examples, Nos. 6, 10 and 13 were performed by the methods disclosed in the JP-B No. 53-35897 in which metal plates were used when the runner bricks were set in the grooves of the stool. In these examples, times for setting of the runner bricks were longer than those of the embodiments of the present invention, because of inserting the metal plates in the gap between the side walls of the groove and the runner brick. In the example No. 6 in which the gap was narrow, flowing out of the molten steel did not occur, but broken pieces of the runner brick broken during the post-treatment after ingot casting entered in the clearance or gap between the bottom portion of the runner bricks and the groove. Therefore, in the post-treatment after ingot casting, a long time was taken for removing the remained the pieces of runner bricks. In the examples Nos. 10 and 13 in which the gap were wider, during ingot casting, molten steel flowed out and solidified within the gap, so that the molten steel remained within the gap with the pieces of the runner bricks, thereby causing the post-treatment after ingot casting to require rather long time.

Comparative example, No. 5 was an example where runner brick setting was performed by the method disclosed in the JP-A No. 6-218494 and sand was not used in the gaps between the side walls of the gap and the runner bricks. In this case, because the sand was not used, time for setting of the runner bricks was shorter than those of the embodiments of the present invention, while flowing out of the molten steel did not occur. However, pieces of the runner bricks broken during the post-treatment after ingot casting entered in the gap between the runner bricks disposed on the bottom side of the groove and the groove. Therefore, in the post-treatment after ingot casting, a long time was required to remove the remained runner brick pieces.

It is clear from the descriptions and embodiments described above that the bottom casting apparatus and method of the present invention provide the advantages such that a leakage of molten steel caused by breaking of the runner bricks during ingot casting can be prevented and also a time for post-treatment after ingot casting can be shortened.

What is claimed is:

1. An apparatus for bottom casting of a molten steel, comprising a pouring pipe, a stool, at least one mold, and at least one runner, each runner being disposed in the stool and connecting between the pouring pipe and each mold, wherein the runner satisfies the following equations (1) and (2), and a gap formed between a side wall of a groove for a runner provided in the stool and a runner brick is filled with heat resisting granules, $$A-D \leqq D(Z/100)+2.5 \text{ (mm)} \quad (1)$$

$$A-D>B-E>0 \quad (2)$$

where A is an upper portion width (mm) of the groove, B is a bottom portion width (mm) of the groove, D is an upper portion width (mm) of the runner brick, E is a lower portion width (mm) of the runner brick, and Z is a mean coefficient (%) of linear expansion of the runner brick in the temperature range of a room temperature to 1000° C.

2. A method for bottom casting of a molten steel using a bottom casting apparatus in which a runner connecting a pouring pipe and a mold is formed in a manner according to the following (a) and (b);

(a) the runner is formed such that a relationship between the groove for a runner provided in the stool and the runner brick disposed on the groove satisfies the following equations (1) and (2); and (b) a gap formed between a side wall of the groove for a runner provided in the stool and the runner brick is filled with heat resisting granules, $$A-D \leqq D(Z/100)+2.5 \text{ (mm)} \quad (1)$$

$$A-D>B-E>0 \quad (2)$$

where A is an upper portion width (mm) of the groove, B is a bottom portion width (mm) of the groove, D is an upper portion width (mm) of the runner brick, E is a lower portion width (mm) of the runner brick, and Z is a mean coefficient (%) of linear expansion of the runner brick in the temperature range of a room temperature to 1000° C.

* * * * *

UNITED STATES PATENT AND TRADEMARK OFFICE

CERTIFICATE OF CORRECTION

PATENT NO. : 6,223,806 B1
DATED : May 1, 2001
INVENTOR(S) : Nishino et al.

It is certified that error appears in the above-identified patent and that said Letters Patent is hereby corrected as shown below:

Title page,
Insert item [73] Assignee is: Sumitomo Metal Industries, Ltd. Osaka, Japan Signed and Sealed this Thirteenth Day of November, 2001

*Attest:*

Nicholas P. Godici

NICHOLAS P. GODICI
*Acting Director of the United States Patent and Trademark Office*

*Attesting Officer*